United States Patent [19]

Haire et al.

[11] Patent Number: 4,927,355

[45] Date of Patent: May 22, 1990

[54] BURNER ASSEMBLY

[75] Inventors: Allen Haire, Garfield Heights, Ohio; Alan C. Abele, Zelienople, Pa.; Stanley W. Kuczek, Aurora, Ohio

[73] Assignee: Enerco Technical Products, Inc., Cleveland, Ohio

[21] Appl. No.: 265,559

[22] Filed: Nov. 1, 1988

[51] Int. Cl.[5] ..... F23D 14/14

[52] U.S. Cl. ..... 431/329

[58] Field of Search ..... 431/114, 328, 329; 239/145; 126/91 R, 92 A C

[56] References Cited

U.S. PATENT DOCUMENTS

| | | | |
|---|---|---|---|
| 3,040,805 | 6/1962 | Lambert | 431/329 |
| 3,084,736 | 4/1963 | Mentel et al. | 431/329 |
| 3,130,482 | 4/1964 | Forniti | 431/328 X |
| 3,185,204 | 5/1965 | Loeb et al. | 431/329 |
| 3,353,583 | 11/1967 | Silhavy et al. | 431/329 |
| 3,363,662 | 1/1968 | Curtis | 431/329 |
| 3,552,378 | 1/1971 | Zavadsky et al. . | |
| 3,635,644 | 1/1972 | Reid, Jr. . | |
| 3,857,670 | 12/1974 | Karlovetz et al. | 431/329 |
| 4,063,873 | 12/1977 | Naito . | |
| 4,340,357 | 7/1982 | Kito et al. . | |

FOREIGN PATENT DOCUMENTS

| | | | |
|---|---|---|---|
| 627548 | 5/1963 | France | 431/329 |

*Primary Examiner*—Randall L. Green

*Attorney, Agent, or Firm*—Fay, Sharpe, Beall, Fagan, Minnich & McKee

[57] ABSTRACT

The subject burner assembly disposes an air inlet along a base surface of a housing opposite from a radiant, multi-ply screen surface. Air enters the inlet for mixture with an associated supply of gas in a mixing chamber. An air/gas mixture exits the mixing chamber and enters a plenum chamber for distribution and combustion on the entire radiant surface. The multi-ply, radiant surface is defined by three separate screens having a predetermined weave pattern. A reverberator is spaced from the radiant surface and reflects heat from the exhaust gas toward the radiant surface.

14 Claims, 3 Drawing Sheets

BURNER ASSEMBLY

BACKGROUND OF THE INVENTION

This invention pertains to the art of burner assemblies, and more particularly to an infrared burner assembly.

The invention is applicable to a burner assembly used as a portable unit and subject to windy or harsh environments and will be described with particular reference thereto. However, it will be appreciated that the invention has broader applications and may be advantageously employed in a wide variety of environments and applications.

Prior designs in existing burner units are subject to a wide variety of problems. The overall goal in designing such a unit is to achieve a radiant surface that provides even, stable heating over the entire surface. This, in turn, provides predictable, uniform heat for whatever final, intended use of the burner unit.

Burner units used in an external environment are often subject to harsh elements, the most significant being windy conditions which adversely impact on the ultimate goal of uniform temperature over the entire heating surface. Oftentimes, an air inlet is too closely disposed to the radiant surface so that backflashing is a common problem. Backflashing results from the recirculation of exhaust gas from the radiant or heating surface to the inlet and/or combustion chamber. The recirculation can provide an unstable operation of the burner unit due to premature combustion of an air/gas mixture.

It is also vital to control distribution of the combusting gas across the radiant surface. Uneven distribution results in cold spots which adversely effect uniform, predictable heating. A wide variety of structures are employed in an effort to stabilize the heating surface. Nonetheless, proposed solutions have not been without problems and not all are adaptable to the particular conditions associated with an external environment.

Another important consideration is the ability to combine the output of individual burner units. Although it is recognized that the burner units are often grouped together for a combined output, designers have often overlooked this ultimate end use and failed to provide a unit that avails itself to a combined or group use.

SUMMARY OF THE INVENTION

This invention contemplates a new and improved burner assembly that overcomes all the above referenced problems and others, providing a stable, uniformly operating assembly that eliminates cold spots and may be combined with like units to increase the overall output.

According to the present invention, there is provided a burner assembly including a housing having an air inlet disposed on a surface opposite from a radiant surface. A mixing means communicates with the inlet and associated supply of gas. A plenum chamber receives a constant and proportioned fuel gas/air ratio which is effectively driven solely by said fuel gas pressure metered through an orifice and directed into a venturi. The plenum chamber also distributes the air/gas mixture to the radiant combustion surface. A reverberator (secondary radiant surface) is spaced from, but disposed adjacent to, the radiant surface (primary radiant surface) and is elevated to luminescence by virtue of oxidizing fuel gas located at the outermost surface of the primary radiant surface allowing radiant heat energy to evenly stabilize the temperature of the primary radiant surface.

According to a more limited aspect of the invention, the radiant surfaces are defined as primary and secondary, and provides means for exhibiting a uniform radiant energy density as its essential output.

According to a further aspect of the invention, the mixing means includes a burner orifice and venturi assembly for controlling inspiration of the air for mixture with the gas prior to entry into the plenum chamber.

A principal advantage of the invention resides in limiting backflashing from the radiant surface to the inlet.

According to another advantage of the invention, stable heating is achieved along the entire radiant surface.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
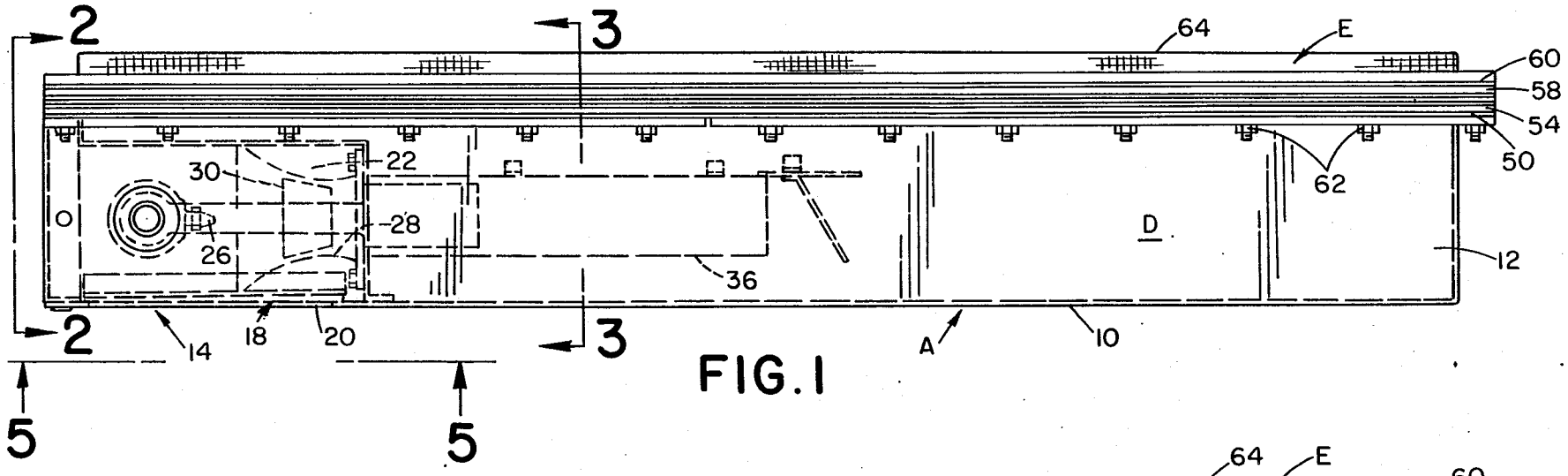
FIG. 1 is a side elevational view of the subject new burner assembly.
Figure 2:
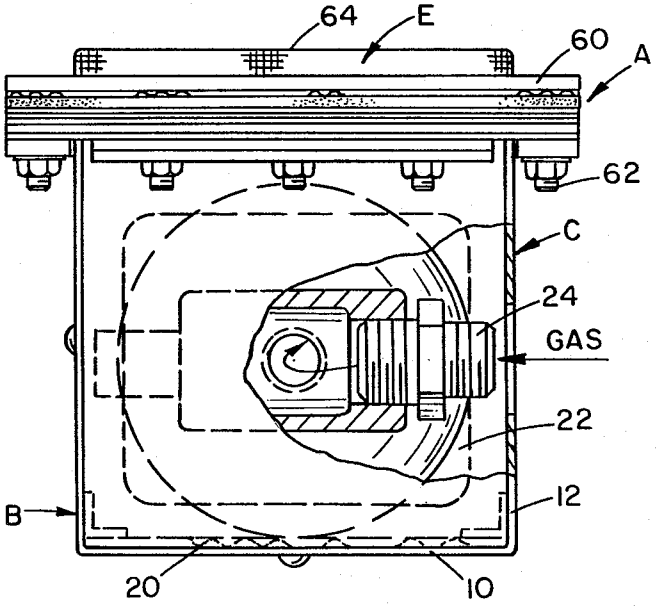
FIG. 2 is an end view of the burner assembly in partial cross-section taken generally along lines 2—2 of FIG. 1.

Referring now to the drawings wherein the showings are for purposes of illustrating the preferred embodiment of the invention only, and not for purposes of limiting same, the FIGURES show a burner assembly A defined in housing B. A mixing means C is defined in the housing and communicates with a plenum chamber D for distributing an air/gas mixture to a radiant surface E for combustion.

Figure 5:
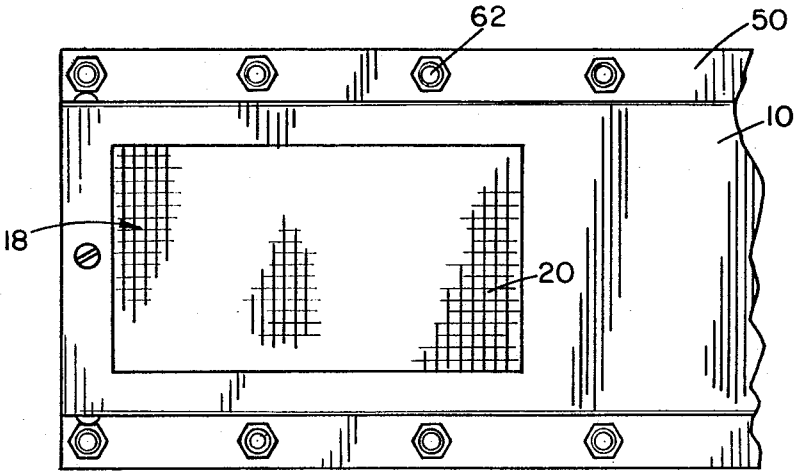
FIG. 5 is a partial bottom view taken generally along lines 5—5 of FIG. 1 and particularly illustrating the air inlet.
Figure 3:
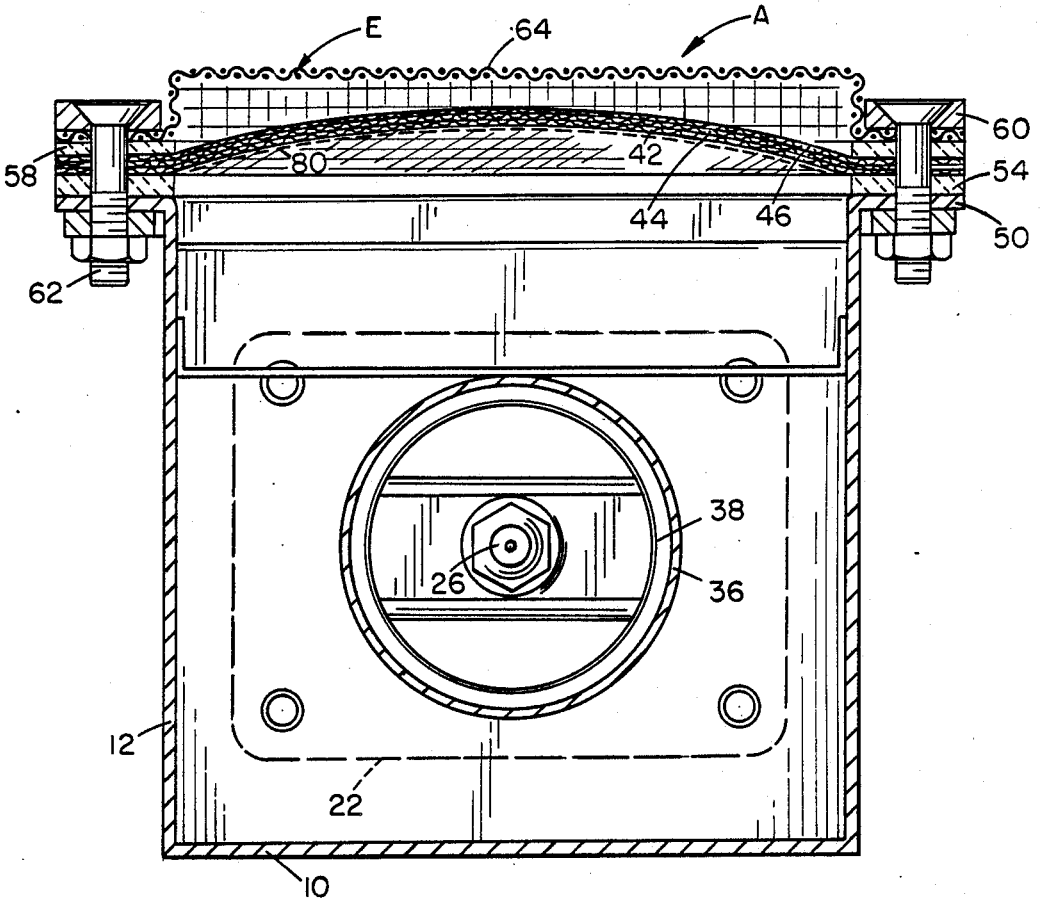
FIG. 3 is a vertical cross-sectional view taken generally along lines 3—3 of FIG. 1.

More particularly, the housing includes a base wall 10 and sidewall 12 and a radiant surface E disposed oppositely from the base wall 10. Adjacent a first end 14 of the housing is disposed an air inlet or opening 18 in a predetermined portion of the base wall. A screen 20 covers the inlet and functions as a means for filtering air drawn into the housing (FIG. 5). The inlet communicates with a mixing chamber 22 in which air and gas are thoroughly mixed. An external supply of gas (not shown) communicates through a suitable fluid passage 24 with the mixing chamber. Specifically, the fluid passage is connected to a burner orifice 26. The orifice directs a pressurized stream of gas toward a converging throat 28. A venturi ring or insert 30 is secured within the throat area to receive the gas from the burner orifice therethrough, inspirate the gas with air, and facilitate compression and mixture of the air and gas prior to ignition. Ignition is effected by an external source located on the outer surface of the primary radiant surface. The particular ignition means forms no part of the subject invention and may be any of a number of conventional structures so that further discussion is deemed unnecessary to a full and complete understanding of the subject invention.

Figure 4:
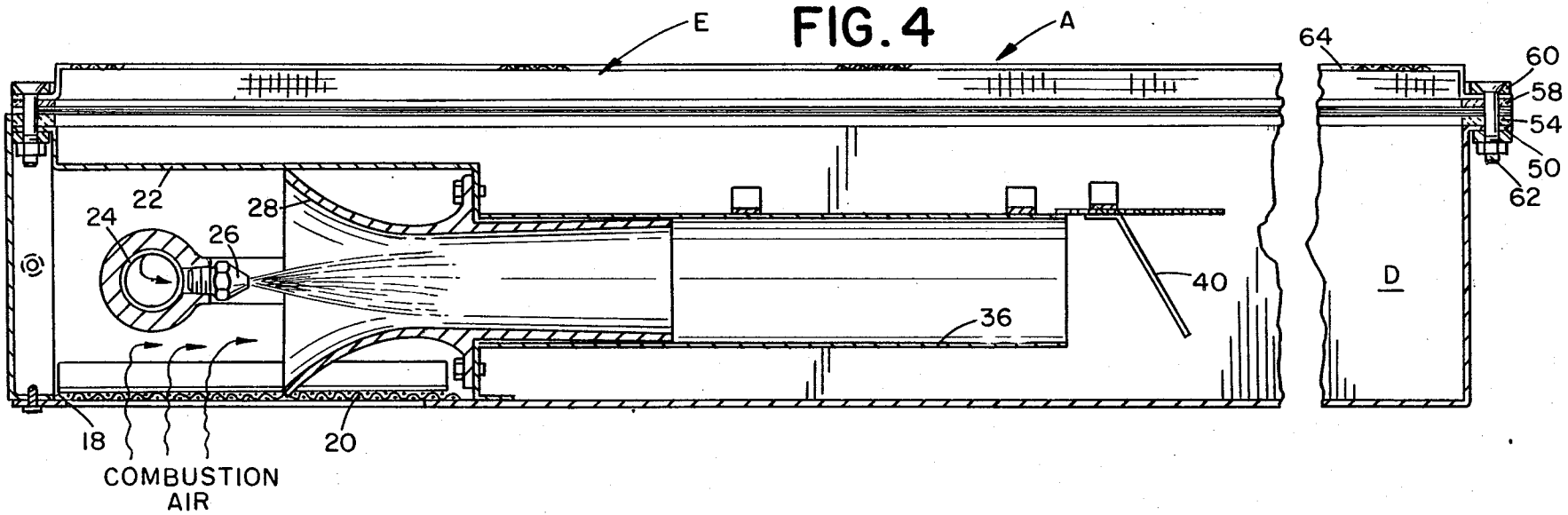
FIG. 4 is a longitudinal cross-sectional view.

The venturi ring is adapted for removal and insertion into the converging throat area of the mixing chamber. In fact, it is contemplated that a number of different sized venturi rings may be provided to provide versatility to a burner assembly user confronted with different combustion gases, gas pressures, etc. It will also be recognized that under selected conditions, the venturi ring can be omitted completely from the burner assembly without adversely effecting efficient operation (FIG. 4). The pressurized gas flowing through the venturi ring and converging throat area draws a predetermined amount of air through the inlet. These components are designed so that if the gas pressure is altered, e.g. five psi to two psi, then suction is correspondingly altered to maintain an optimum air/gas mixture.

The air/gas mixture exiting the mixing chamber enters the plenum chamber D through a generally cylindrical passage 36. The converging throat area merges into a slightly diverging region 38 which is, in turn, received in the cylindrical passage. The air/gas mixture exits the cylindrical passage and impinges on a deflector plate 40 for distribution throughout the entire housing. The plenum chamber communicates with the radiant surface E where oxidation of fuel at the outermost surface occurs.

Figure 6:
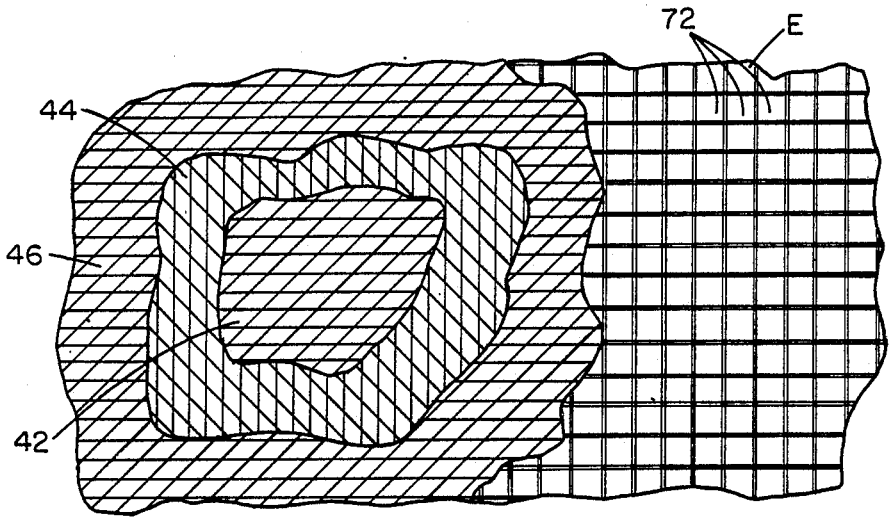
FIG. 6 is an enlarged view of the radiant surface and reverberator structure of the subject invention; and, FIG. 7 is a plan view of the burner assembly on a reduced scale with portions of the radiant surface and reverberator removed for ease of illustration.

The radiant surface includes a multi-ply screen assembly defined by first, second, and third screens 42, 44, 46. As is apparent from FIG. 6, the weave of each screen is angularly disposed relative to both the longitudinal and lateral extent of the housing. The weave of the screens is approximately 45° relative to either the longitudinal or lateral axis of the burner assembly. This arrangement permits the screens to expand in a uniform manner during heating.

The weave of the first screen is angularly disposed approximately 45° relative to the longitudinal extent of the housing. The second screen extends generally perpendicular to the first screen in a crossing pattern and, therefore, is also disposed approximately 45° relative to the longitudinal extent of the housing. Likewise, the third screen is also angularly disposed in such a manner relative to the second screen and its weave pattern closely approximates that of the first screen. A series of small openings are defined through the screen assembly and permit combustion of the air/gas or fuel mixture as it passes upwardly through the screen. Any conventional means for initially sparking or igniting the air/gas mixture at the radiant surface can be utilized and as will be understood by those of ordinary skill in the art. The screens are heated to an elevated temperature approximating 1,650° F. and maintain combustion of the air/gas mixture.

The screen assembly preferably has a convex formation. The convex formation facilitates infusion of air to the burner assembly for efficient combustion on the radiant surface. A peripheral edge of the screen assembly is generally planar and is secured to the housing. Specifically, flange 50 is integrally formed along an upper extent of the sidewall. A first gasket 54 is interposed between the flange and the multi-ply screen assembly. A second gasket 58 is disposed along an upper surface of the screen assembly.

A reverberator E defined by a coarse mesh structure is secured between the screen assembly and a frame 60. Elongated bolts 62 or similar securing means extend through the frame, reverberator, second gasket, multi-ply screen, first gasket and flange to provide a sealed peripheral edge of the burner assembly. The reverberator has a central raised portion 64 that is spaced a predetermined distance from the multi-ply screen assembly. Openings 72 through the reverberator are substantially larger than the openings defined in the multi-screen assembly. Thus, the reverberator does not define a primary heat exchange surface with the exhausting, combusted gas mixture as in the multi-screen assembly. Nevertheless, the reverberator serves as a means for reflecting radiant heat onto the screen assembly and more evenly distributing the heat over the entire primary radiant surface.

Figure 7:
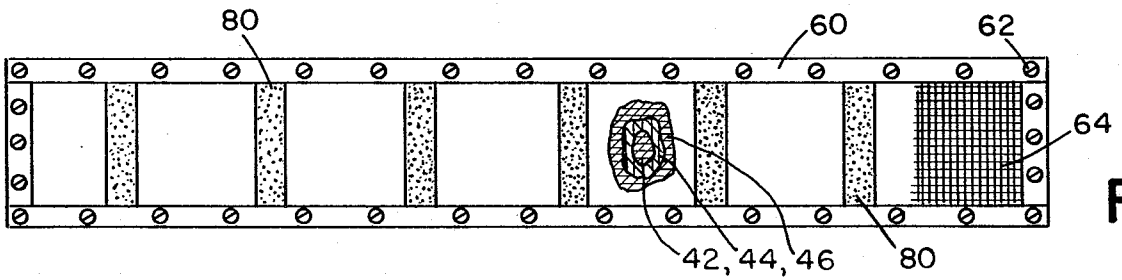

Turning now to FIG. 7, and with continued reference to FIG. 4, means for compressing the multi-ply screen assembly may be incorporated into the burner assembly. For example, a single perforated sheet of material may extend directly beneath the entire multi-ply screen assembly. Alternatively, distinct perforated strips of material 80 may extend laterally beneath the multi-ply screen assembly. Whether a single sheet or multiple strips are utilized, the material is adapted to compress the screens together and eliminate formation of gaps that could adversely effect the combustion process. Preferably the material 80 has a coefficient of thermal expansion greater than the screens 42, 44, 46 so that the screens are pressed together as the temperature of the burner assembly increases.

The described structure offers a number of benefits over prior art structures. The weave pattern of the screen assembly permits the individual screens to expand in a uniform manner during heating. This eliminates excessive metal fatigue typical of grid surfaces not configured in this manner. Disposing the air inlet along the bottom surface positions the combustion air as great a distance as possible from the radiant surface to limit backflashing. This, in turn, provides for a more predictable combustion of the air/gas mixture. Disposition of the air inlet along the bottom or base surface also limits the effects of a windy environment. The preferred structural arrangement maintains a stable flame pattern that remains unaffected by ambient environmental conditions.

The invention has been described with reference to the preferred embodiment. Obviously modifications and alterations will occur to others upon a reading and understanding of this specification. It is intended to include all such modifications and alterations in so far as they come within the scope of the appended claims and the equivalents thereof.

Having thus described the invention, it is now claimed:

1. A burner assembly comprising:

a housing having first and second surfaces spaced by a sidewall;

an air inlet defined on said first surface and adapted to communicate with a supply of gas;

means for mixing air and gas in said housing;

a plenum chamber defined in said housing operatively associated with said mixing means;

a radiant surface defined by a multi-ply screen assembly communicating with said plenum chamber and defining a combustion surface, said radiant surface being disposed on said housing at said second surface opposite said air inlet for eliminating backflashing;

means for compressing the multi-ply screen assembly wherein the compressing means has a coefficient of thermal expansion greater than said multi-ply screen assembly; and a reverberator extending adjacent said radiant surface for reflecting heat from said radiant surface.

2. The burner assembly as defined in claim 1 wherein said mixing means is disposed entirely in said housing.

3. The burner assembly as defined in claim 1 wherein said mixing means includes a burner orifice and venturi, said orifice receiving an associated supply of gas and directing the gas to said venturi.

4. The burner assembly as defined in claim 1 wherein said multi-ply screen includes first, second, and third screens.

5. The burner assembly as defined in claim 4 wherein said radiant surface is generally rectangular and the wave of said screens is disposed in non-perpendicular relation to edges of the radiant surface.

6. A burner assembly comprising:

a housing having a (i) base wall, (ii) sidewall, and (iii) radiant surface;

said base wall including an inlet opening adapted to receive air therethrough;

a mixing means received entirely within said housing, said mixing means including a burner orifice and venturi member communicating with said inlet opening, said venturi member defined by an annular ring disposed in a converging passage, said burner orifice directing the associated gas through said ring and air being drawn from said inlet opening around the exterior of said ring for mixture with the gas;

a plenum chamber operatively associated with said mixing means and adapted to receive an air/gas mixture therefrom for distribution to said radiant surface;

said radiant surface oppositely disposed from said base wall by said sidewall to limit backflashing, said radiant surface including a multi-ply screen in which individual screens are angularly disposed relative to one another; and, a reverberator spaced from said multi-ply screen for reflecting heat from said radiant surface.

7. The burner assembly as defined in claim 6 wherein said multi-ply screen extends over said plenum chamber and is secured to said housing by a frame extending along the periphery of said screen.

8. The burner assembly as defined in claim 7 wherein said multi-ply screen includes first, second, and third individual screens, each screen having a weave pattern disposed at approximately 45° to the longitudinal and lateral extent of said frame.

9. A burner assembly comprising:

a housing having a base wall and sidewall;

said base wall including an inlet opening adapted to receive air therethrough;

mixing means communicating with said inlet opening and adapted for connection with an associated supply of gas, said mixing means includes a burner orifice and venturi disposed in a converging throat area adapted to mix air and gas;

a plenum chamber defined in said housing adapted to receive an air/gas mixture from said mixing means;

means for distributing the air/gas mixture in said plenum chamber;

a radiant surface communicating with said plenum chamber and defining a combustion surface for the air/gas mixture, said radiant surface including a multi-ply screen assembly disposed on said housing at an area opposite said inlet opening for eliminating backflashing;

means for compressing the multi-ply screen assembly wherein said compressing means has a coefficient of thermal expansion greater than said multi-ply screen assembly; and, a reverberator extending adjacent said radiant surface for reflecting heat from said radiant surface.

10. The burner assembly as defined in claim 9 further comprising first and second gaskets interposed between said housing and radiant surface, and said radiant surface and reverberator, respectively.

11. The burner assembly as defined in claim 9 wherein said reverberator has a central raised portion spaced from said radiant surface.

12. The burner assembly as defined in claim 11 wherein said multi-ply screen assembly includes first, second, and third screens.

13. The burner assembly as defined in claim 12 wherein each of said screens has a weave pattern disposed in non-perpendicular relation to the edges of the radiant surface.

14. The burner assembly as defined in claim 12 wherein each of said screens has a weave pattern disposed at approximately 45° to the longitudinal and lateral extent of the burner assembly.

* * * * *